US007686301B2

(12) United States Patent
Kakishima

(10) Patent No.: US 7,686,301 B2
(45) Date of Patent: Mar. 30, 2010

(54) PRINTING APPARATUS, FEEDING APPARATUS, AND FEEDING CONTROL METHOD

(75) Inventor: Hiroyuki Kakishima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 176 days.

(21) Appl. No.: 11/767,107

(22) Filed: Jun. 22, 2007

(65) Prior Publication Data

US 2008/0006984 A1 Jan. 10, 2008

(30) Foreign Application Priority Data

Jul. 6, 2006 (JP) ..... 2006-186978

(51) Int. Cl.
*B65H 5/00* (2006.01)

(52) U.S. Cl. ..... 271/264; 271/176; 271/265.01

(58) Field of Classification Search ..... 271/264, 271/265.01, 266, 270, 176
See application file for complete search history.

(56) References Cited

U.S. PATENT DOCUMENTS

| | | | | |
|---|---|---|---|---|
| 6,168,333 | B1 * | 1/2001 | Merz et al. | 400/634 |
| 6,827,421 | B2 * | 12/2004 | Nunokawa et al. | 347/19 |
| 7,334,787 | B2 | 2/2008 | Akiyama et al. | 271/10.02 |
| 2006/0222433 | A1 * | 10/2006 | Terada et al. | 400/624 |
| 2008/0237979 | A1 * | 10/2008 | Tamura et al. | 271/270 |

FOREIGN PATENT DOCUMENTS

| | | |
|---|---|---|
| JP | 3352612 B2 | 9/2002 |
| JP | 2003-79184 | 3/2003 |
| JP | 2003-291433 | 10/2003 |
| JP | 2005-335302 | 12/2005 |

OTHER PUBLICATIONS

U.S. Appl. No. 11/770,146, filed Jun. 28, 2007, H. Kakishima, et al.
U.S. Appl. No. 11/842,553, filed Aug. 21, 2007, H. Saito, et al.
Official Letter/Search Report, issued Dec. 14, 2009, by the Japanese Patent Office, in Japanese Patent Application No. 2007-163020.

* cited by examiner

*Primary Examiner*—Patrick H Mackey
*Assistant Examiner*—Michael C McCullough
(74) *Attorney, Agent, or Firm*—Fitzpatrick, Cella, Harper & Scinto

(57) ABSTRACT

A printing apparatus, a feeding apparatus, and a feeding control method supply an object accurately to a target position by servo control even though the load abruptly changes. In this printing apparatus, the conveyance position and conveyance speed of a printing medium are detected by using an encoder. The conveyance target position of the printing medium is generated at a predetermined period, and corrected. A PWM signal is generated on the basis of the generated or corrected conveyance target position, and the conveyance position and conveyance speed of the printing medium which are detected and fed back. A DC motor is servo-controlled by the PWM signal. At this time, the generated or corrected conveyance target position is compared with the detected conveyance position of the printing medium. Control is made to perform correction in accordance with the comparison result.

9 Claims, 12 Drawing Sheets

PRINTING APPARATUS, FEEDING APPARATUS, AND FEEDING CONTROL METHOD

BACKGROUND OF THE INVENTION

1. Field of the Invention

The present invention relates to a printing apparatus, feeding apparatus, and feeding control method. Particularly, the present invention relates to a printing apparatus and a feeding control method which supply a printing medium such as a printing paper sheet and print on the printing medium by causing a printhead to discharge ink.

2. Description of the Related Art

Many of recent printing apparatuses employ a DC motor serving as a driving source and servo control that allows high-speed driving and accurate position control by feeding back position detection information obtained by an encoder.

Especially, control using a DC motor enables high-speed rotation without step out, unlike control using a pulse motor. Motor position information can be detected accurately by using an encoder signal. Since the detection information is fed back to the motor control rule, accurate speed control and positioning with respect to a target position can be performed.

For example, Japanese Patent No. 3352612 discloses such a technique.

In this prior art, a target position that progressively increases to a final target position is generated in every servo period. However, if the load on the mechanism of a printing apparatus largely varies during servo control, the speed also largely varies.

FIG. 10 is a graph showing an example of time variations in the target position and detected position.

As shown in FIG. 10, a target position that increases by ΔP in every servo period (ΔT) is given. When the load on the mechanism of the printing apparatus increases at time T=T1, the PWM output signal of servo control continuously takes an upper limit value (PWM_MAX). In this case, the detected position (actual position) is unable to track the target position and greatly deviates from the target position. The load is eliminated at time T=T2. Then, the detected speed becomes much higher than the target speed to recover the position deviation. When the detected speed is high, deceleration is started by servo control to ensure a speed close to the target speed.

FIG. 11 is a graph showing comparison between a target position profile and a detected position profile and comparison between a target speed profile and a detected speed profile. Times T=T1 and T=T2 indicate the time when the load on the mechanism starts increasing and the time when the heavy load is eliminated, respectively, as in FIG. 10.

As shown in FIG. 11, at time T=T2, the heavy load is eliminated, and the detected speed increases to recover the delay in position detection. Even when deceleration starts abruptly, the correct final target position cannot be obtained.

SUMMARY OF THE INVENTION

Accordingly, the present invention is conceived as a response to the above-described disadvantages of the conventional art.

For example, a printing apparatus, a feeding apparatus, and a feeding control method according to this invention are capable of supplying an object accurately to a target position by servo control even when the load abruptly changes.

According to one aspect of the present invention, preferably, there is provided a printing apparatus for printing on a printing medium by a printhead, comprising: a first roller which conveys the printing medium from a stacking position of the printing medium into the apparatus; a DC motor which supplies a driving force to the first roller; an encoder which detects a rotation amount of the first roller; generation means for generating a target position to cause the first roller to feed the printing medium; correction means for correcting the target position generated by the generation means; control means for generating a PWM signal on the basis of the target position generated by the generation means or corrected by the correction means and the rotation amount detected by the encoder, and servo-controlling the DC motor by the PWM signal; first comparison means for comparing the target position generated by the generation means or corrected by the correction means with the rotation amount detected by the encoder; and correction control means for controlling the correction means to perform correction in accordance with a comparison result from the first comparison means.

According to another aspect of the present invention, preferably, there is provided a feeding apparatus which conveys a stacked printing medium to a predetermined position, comprising: a first roller which conveys the printing medium from a stacking position of the printing medium into the apparatus; a DC motor which supplies a driving force to the first roller; an encoder which detects a rotation amount of the first roller; generation means for generating a target position to cause the first roller to feed the printing medium; correction means for correcting the target position generated by the generation means; control means for generating a PWM signal on the basis of the target position generated by the generation means or corrected by the correction means and the rotation amount detected by the encoder, and servo-controlling the DC motor by the PWM signal; comparison means for comparing the target position generated by the generation means or corrected by the correction means with the rotation amount detected by the encoder; and correction control means for controlling the correction means to perform correction in accordance with a comparison result from the comparison means.

According to still another aspect of the present invention, preferably, there is provided a method of feeding a stacked printing medium via a roller to which a driving force is supplied from a servo-controlled DC motor, comprising the steps of: detecting a rotation amount of the roller by using an encoder; generating a target position to feed the printing medium by the roller; correcting the target position generated in the generating step; generating a PWM signal on the basis of the target position generated in the generating step or corrected in the correcting step and the rotation amount detected by the encoder, and servo-controlling the DC motor by the PWM signal; comparing the target position generated in the generating step or corrected in the correcting step with the rotation amount detected by the encoder; and controlling to perform correction in the correcting step in accordance with a comparison result in the comparing step.

The invention is particularly advantageous since an object of servo control such as a printing medium can accurately be supplied to a target position even when the load largely varies during servo control.

Further features of the present invention will become apparent from the following description of exemplary embodiments (with reference to the attached drawings).

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "link" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Figure 1:
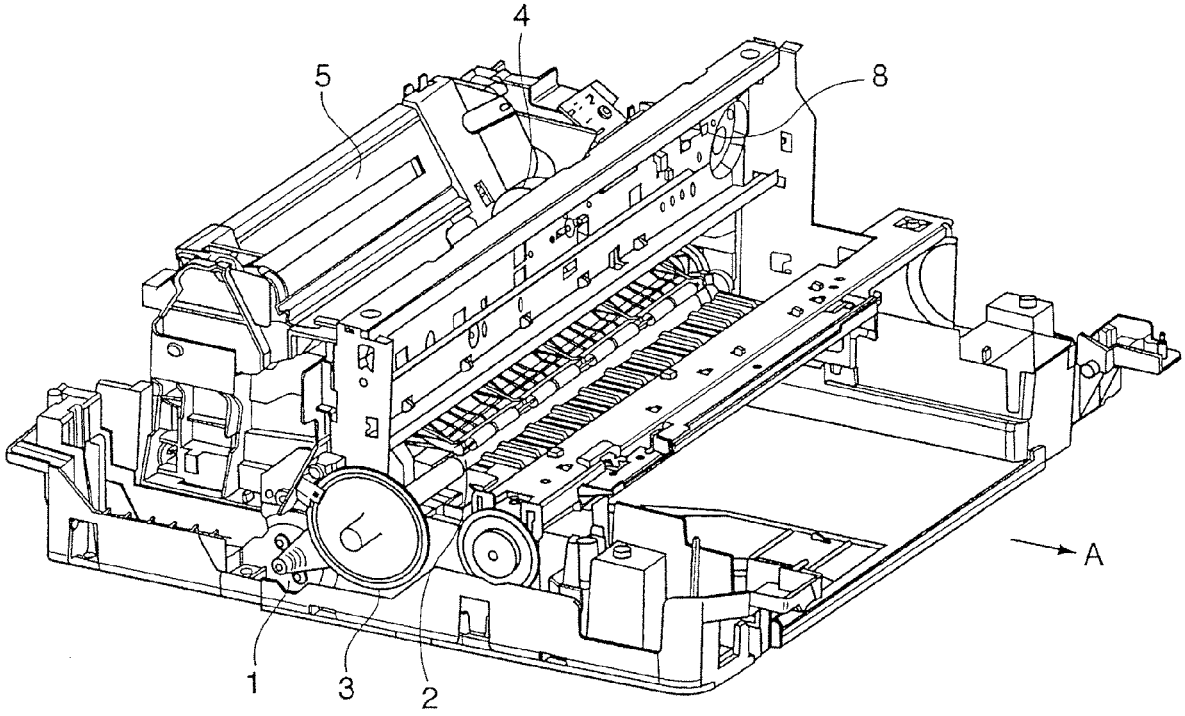
FIG. 1 is a perspective view showing the schematic arrangement of an inkjet printing apparatus according to a typical embodiment of the present invention.

FIG. 1 is a perspective view showing the mechanism of a printing apparatus according to a typical embodiment of the present invention, which prints by using an inkjet printhead.

Referring to FIG. 1, a motor 1 serves as a driving source to convey a printing medium such as a printing paper sheet. A conveyance (LF) roller 2 conveys a printing medium. An encoder 3 is attached coaxially with the LF roller 2 to detect its position and speed. A feed roller 4 feeds a printing medium. A platen 5 presses stacked printing media against the feed roller 4. A feed lever 8 connects driving of the LF roller 2 to that of the feed roller 4. In this embodiment, a DC motor is used as the motor 1.

When a carriage (not shown) to which an inkjet printhead (to be referred to as a printhead hereinafter) is mounted moves to bring down the feed lever 8, driving of the LF roller 2 connects to the feed roller 4.

Figure 2:
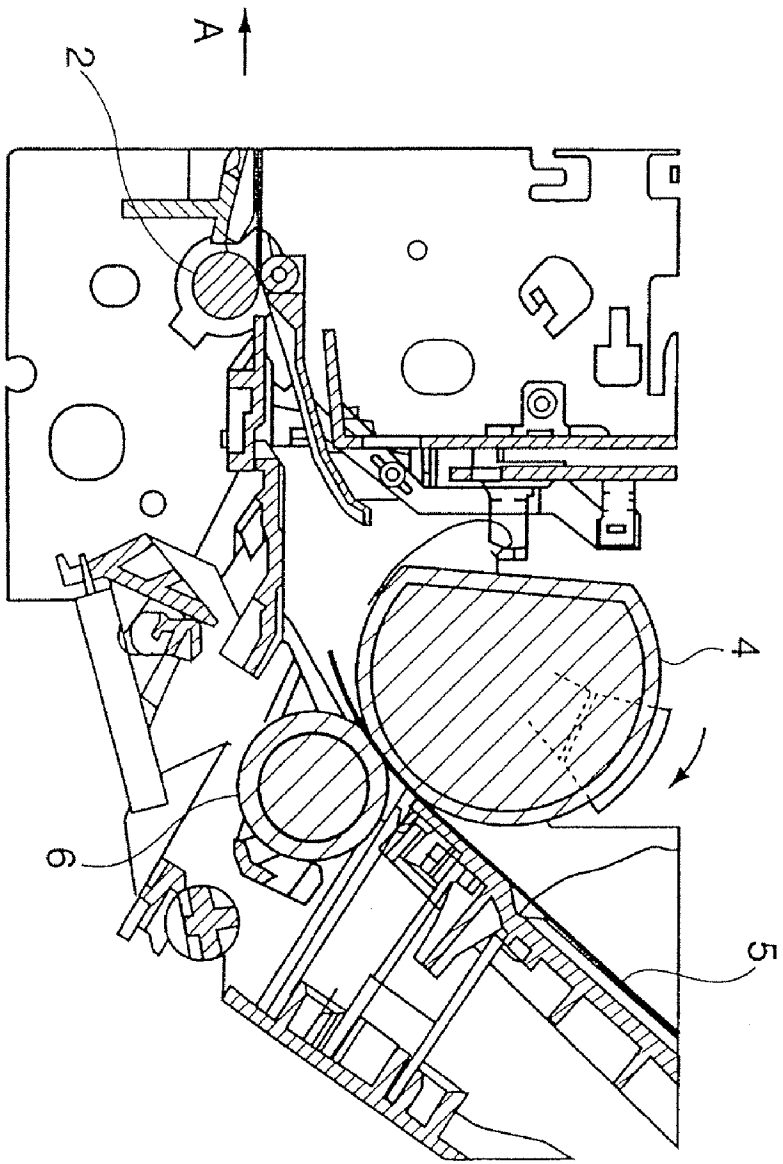
FIGS. 2 and 3 are side sectional views showing the arrangement of the conveyance mechanism of the inkjet printing apparatus shown in FIG. 1.
Figure 3:
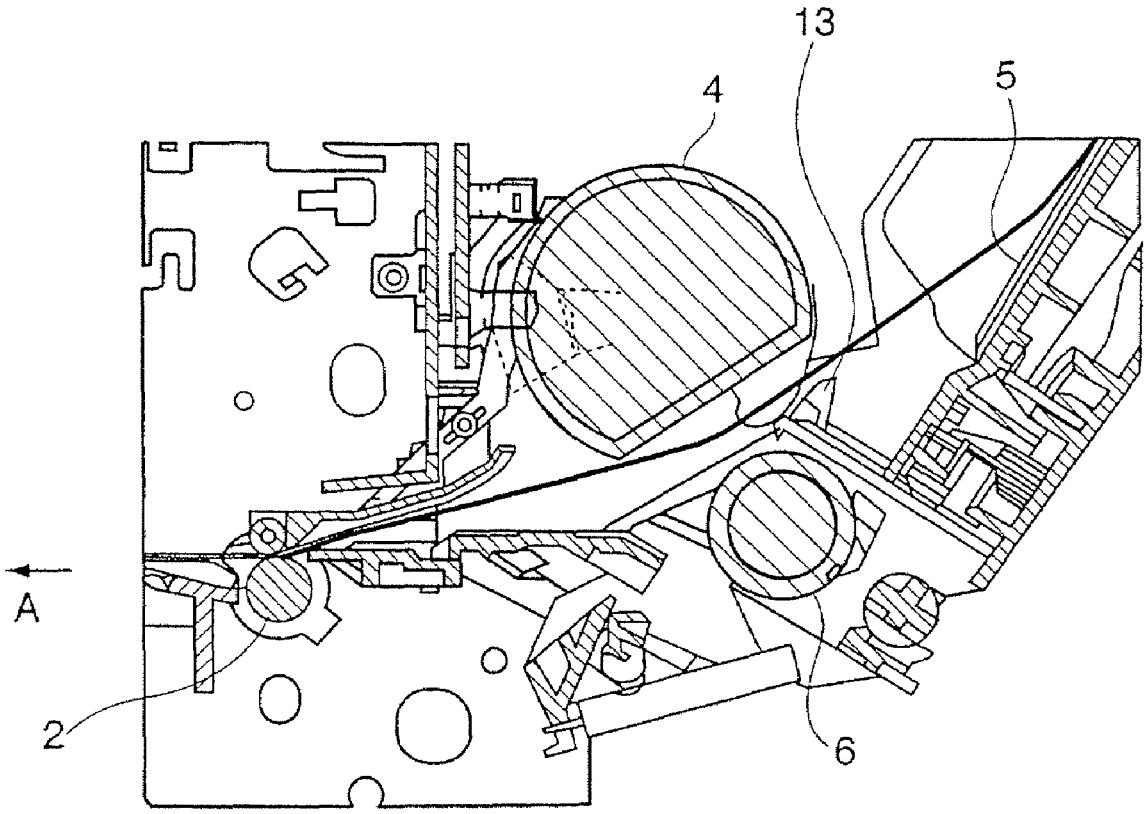

FIGS. 2 and 3 are side sectional views showing the arrangement of the conveyance mechanism of the inkjet printing apparatus shown in FIG. 1.

Referring to FIGS. 2 and 3, a separation roller 6 separates, e.g., one printing paper sheet from, e.g., stacked printing paper sheets.

When the feed operation starts, the platen 5 moves upward and presses printing paper sheets against the feed roller 4 so that the feed roller 4 and separation roller 6 pinch a paper sheet, as shown in FIG. 2. At this time, the load on the conveyance mechanism becomes heavy. When the feed roller 4 and separation roller 6 pinch a paper sheet, a return lever 13 returns the remaining paper sheets to the platen 5. When the return lever 13 moves as above, the load becomes heavier. As the number of paper sheets returned by the return lever 13 increases, the load becomes heavier. Note that the return lever 13 is spaced apart from the feed roller 4 in the widthwise direction of the paper sheets. When the separated printing paper sheet is conveyed to near the LF roller 2, which may serve as the second roller, the platen 5 moves downward so that the feed roller 4 separates from the separation roller 6, as shown in FIG. 3. At this time, the load on the conveyance mechanism is eliminated.

In this printing apparatus, the load on the conveyance mechanism varies during the period when the platen 5 and separation roller 6 move up and down, as described above. The load generated when the above-described return lever 13 moves changes depending on the number of paper sheets returned by the return lever 13 in every feed operation.

Figure 4:
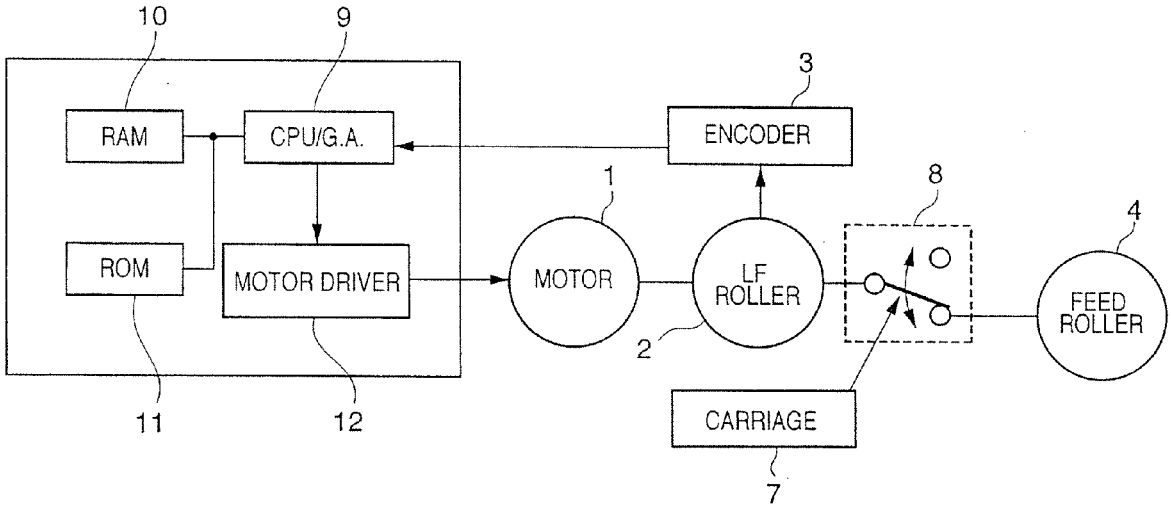
FIG. 4 is a block diagram showing a control arrangement of the printing apparatus shown in FIG. 1.

FIG. 4 is a block diagram showing a control arrangement of the printing apparatus shown in FIGS. 1 to 3.

The LF roller 2 and feed roller 4 are rotated by the common motor 1 serving as a driving source. In this embodiment, the motor 1 transmits its driving force to the LF roller 2 directly but to the feed roller 4 via the feed lever 8. In a case where the feed lever 8 transmits the driving force, both the feed roller 4 and the LF roller 2 rotate upon driving the DC motor. On the other hand, in a case where the feed lever 8 does not transmit driving force, only the LF roller 2 rotates upon driving the DC motor.

The motor 1 can rotate to convey the printing medium both in the direction of an arrow A in FIGS. 1 to 3 (forward rotation) and in a direction reverse to the arrow A (reverse rotation). A CPU/G.A. (Gate Array) 9 gives an instruction about the rotation direction to the motor 1 through a motor driver 12. The motor 1 is PWM-controlled (to be described later) via the motor driver 12.

The CPU/G.A. 9 controls the overall printing apparatus on the basis of control programs, various parameters, and speed driving patterns stored in a ROM 11 by using a RAM 10 as a work area for program execution. The CPU/G.A. 9 also executes an arithmetic process for PWM control. The RAM 10 also serves as a buffer to store image data transferred from an external device (not shown) such as a personal computer or digital camera.

The CPU/G.A. 9 receives the output from the encoder 3 and, on the basis of it, obtains the rotational speed of the LF roller 2 and its conveyance amount.

As described in connection with FIG. 1, when a carriage 7 to which a printhead is mounted moves to a predetermined position to bring down the feed lever 8, the driving force of the motor 1 is transmitted to the feed roller 4. When the carriage 7 moves to another position, the feed lever 8 rises and returns to the initial state.

Figure 5:
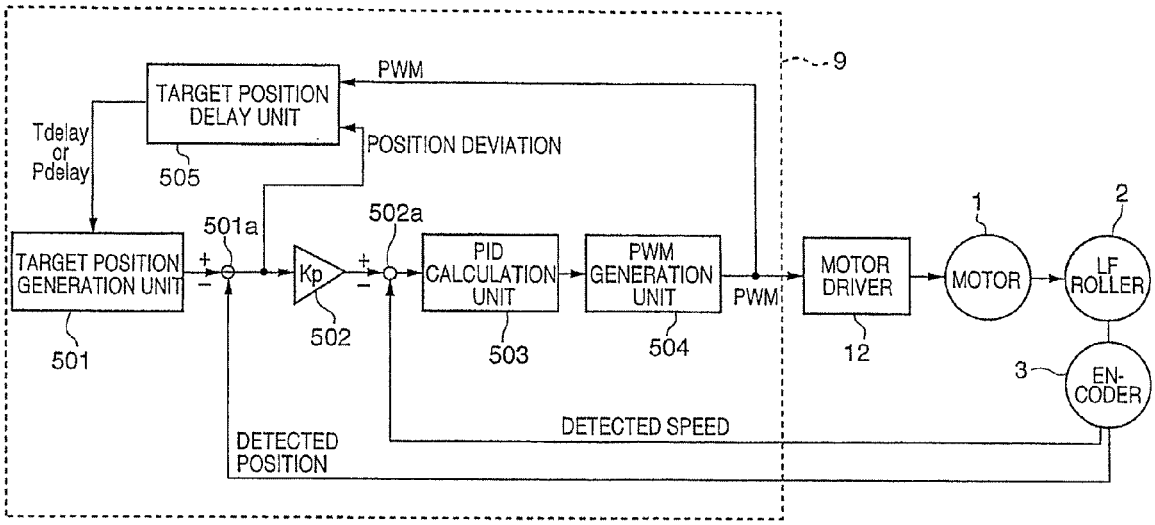
FIG. 5 is a block diagram showing the functional arrangement of servo control of a motor that drives a conveyance roller and a feed roller.

FIG. 5 is a block diagram showing the functional arrangement of servo control of the motor that drives the conveyance roller and the feed roller.

Servo control of this embodiment is implemented by an ASIC (not shown) incorporated in the CPU/G.A. 9 and by causing the CPU/G.A. 9 to execute a control program stored in the ROM 11. The constituent elements in an area indicated by the broken line in FIG. 5 correspond to functions implemented by the program or ASIC. The servo control process is repeatedly performed in every servo period (ΔT).

A target position generation unit 501 generates a target position that progressively increases to a final target position (e.g., the print start position of a printing paper sheet) by servo control. The rotational speed and rotation amount of the LF roller 2 are obtained from the output from the encoder 3. They correspond to the conveyance speed of the printing medium and the conveyance position of the printing medium (tip), respectively. This calculation is well-known, and a description thereof will be omitted. Information about the conveyance speed (rotational speed) and conveyance position (rotation amount) are fed back to the CPU/G.A. 9 shown in FIG. 5.

In a case where the driving force of the DC motor is transmitted to the feed roller 4, the gear ratio between the feed roller 4 and the LF roller 2 is known in advance. It is possible to derive, on the basis of the gear ratio, the rotation amount of the feed roller 4 from that of the LF roller 2 and the rotational speed of the feed roller 4 from that of the LF roller 2.

In control to rotate the feed roller 4, the CPU/G.A. 9 can acquire the information of the rotation amount and speed of the feed roller 4 by using the signal from the encoder 3 provided on the rotating LF roller 2. The CPU/G.A. 9 acquires information via the encoder 3 provided on the LF roller 2, thereby controlling rotation of the feed roller 4.

More specifically, an adder 501*a* feeds back the position information to the target position from the target position generation unit 501. An adder 502*a* feeds back the speed information to the target speed from a differentiating circuit 502. The target position is represented by, e.g., a rotation amount. The output from the adder 501*a* is input to a target position delay unit 505 as a position deviation. That is, the deviation between rotation amount information generated by the target position generation unit 501 and rotation amount information obtained from the encoder 3 is obtained and input to the target position delay unit 505.

A PWM (Pulse Width Modulation) signal is calculated through a PID calculation unit 503 and a PWM generation unit 504 on the basis of the speed corrected by the speed information from the encoder 3, and output to the motor driver 12. The PWM generation unit 504 also outputs the PWM signal to the target position delay unit 505. The PWM signal is represented by a duty value (the ratio of high level and low level, i.e., the ratio of ON and OFF of a pulse signal during a predetermined time). The duty value ranges from 0% to 100%. The larger the duty value becomes, the larger the power supplied to the motor becomes.

The target position delay unit 505 receives the position deviation and the PWM signal, and outputs a delay (Tdelay) from the ideal detection time of the target position or a deviation (Pdelay) from the ideal target position to the target position generation unit 501. The target position generation unit 501 generates a target position at a time later by the received delay (Tdelay) or a target position smaller by the received deviation (Pdelay).

How to generate the delay (Tdelay) or deviation (Pdelay) in the target position delay unit will be described next with reference to flowcharts and time variations in the detected position and detected speed.

Figure 6:
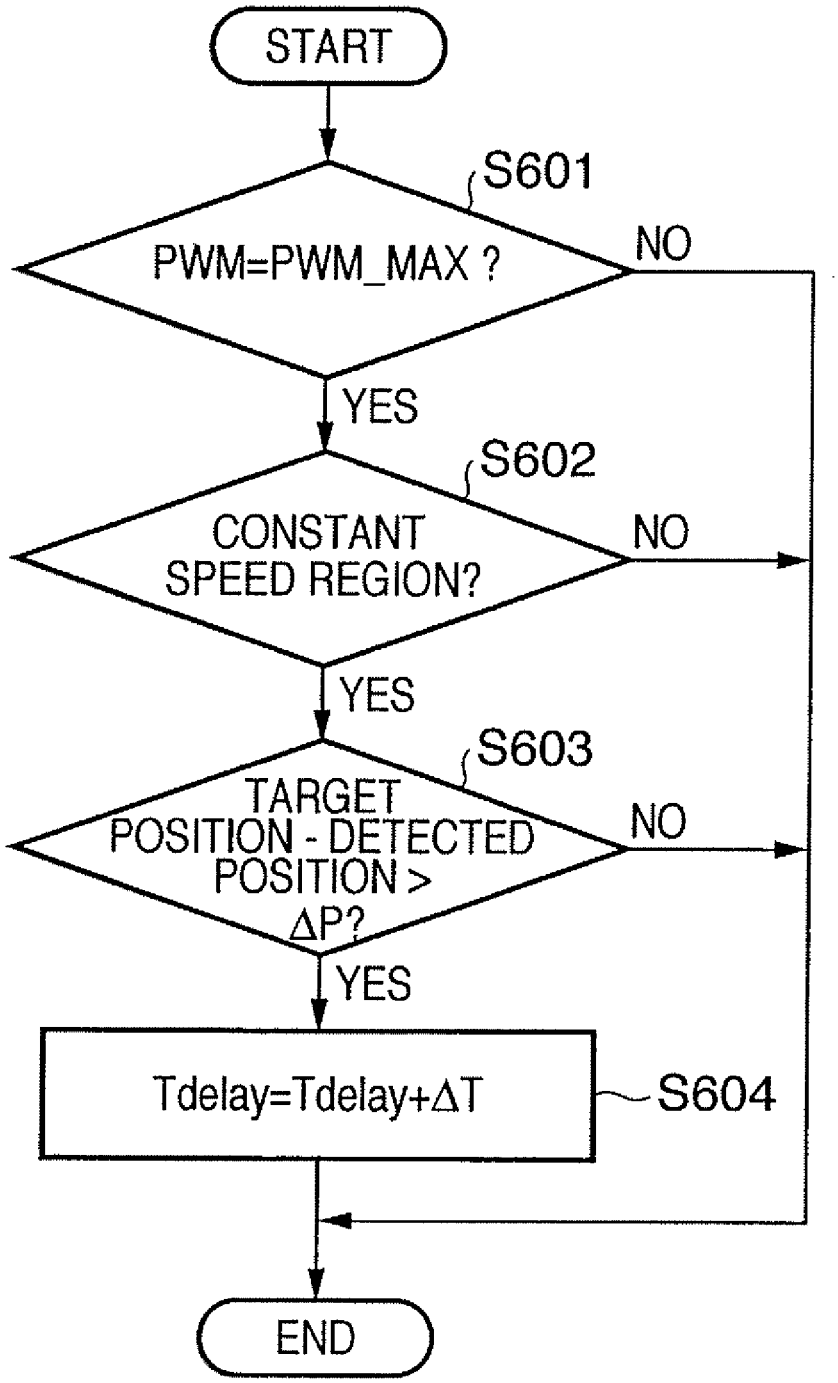
FIG. 6 is a flowchart illustrating a process of a target position delay unit.

FIG. 6 is a flowchart illustrating a process of the target position delay unit, which is repeatedly executed in every servo period (ΔT). This control process is executed upon driving the feed roller.

Figure 7:
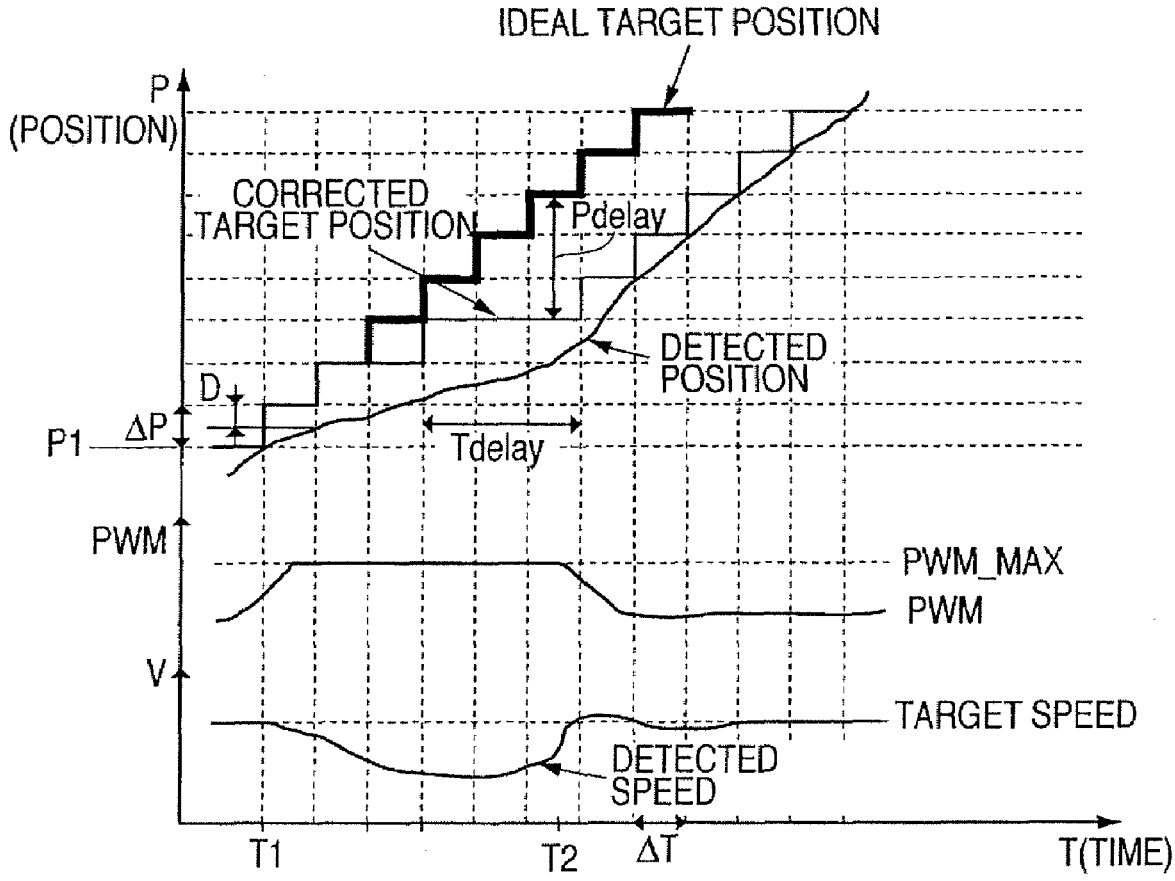
FIG. 7 is a graph showing time variations in the detected position, detected speed, ideal target position, and corrected target position.
Figure 10:
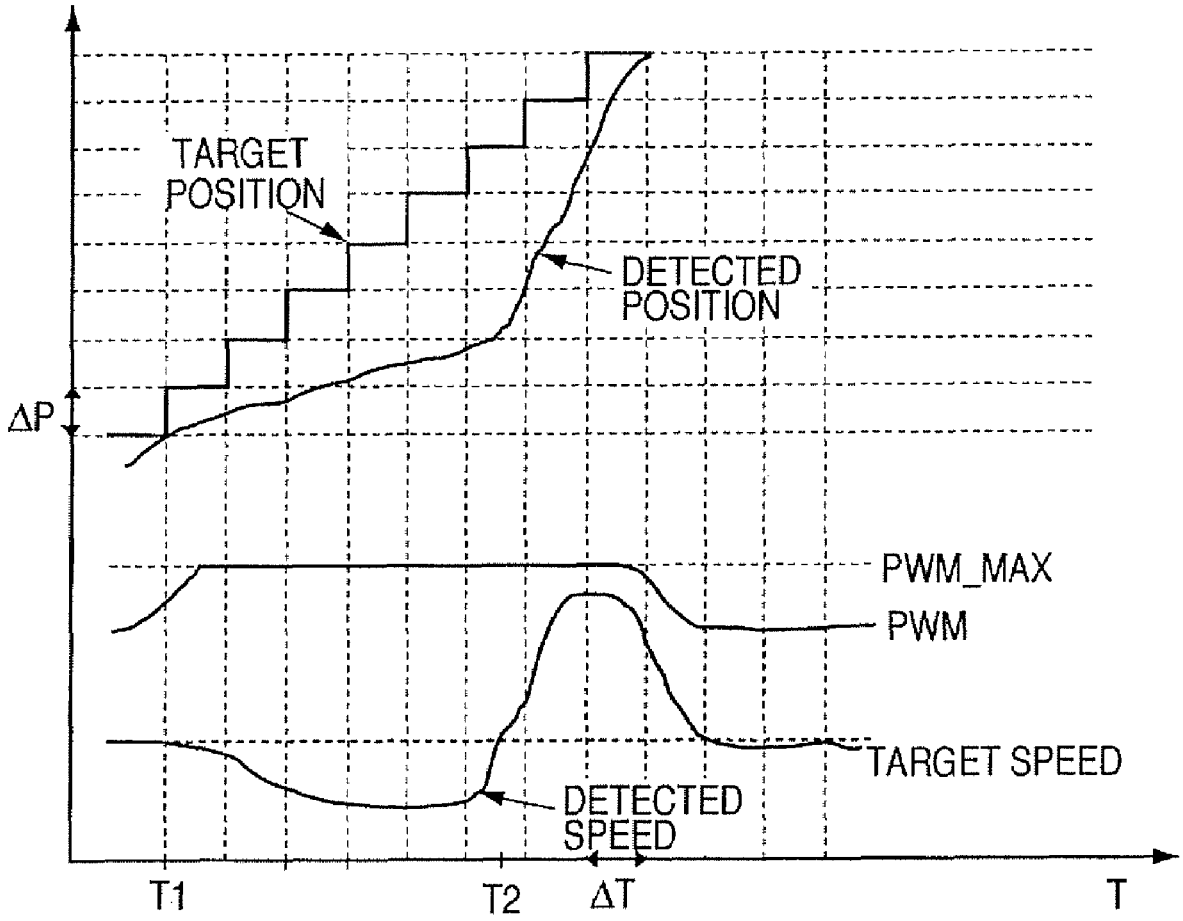
FIG. 10 is a graph showing an example of time variations in the target position and detected position.
Figure 11:
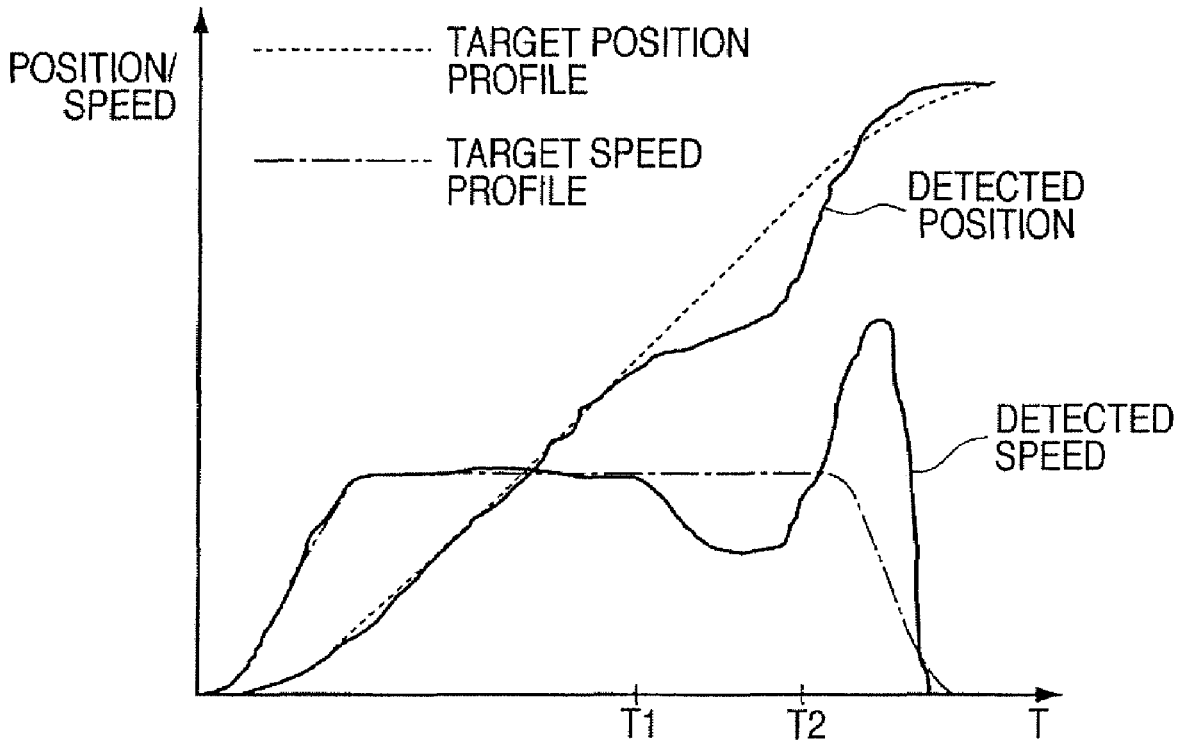
FIG. 11 is a graph showing comparison between a target position profile and a detected position profile and comparison between a target speed profile and a detected speed profile.

FIG. 7 is a graph showing time variations in the detected position, detected speed, ideal target position, and corrected target position. Referring to FIG. 7, a bold line indicates the ideal target position, and a thin line indicates the corrected target position. The ideal target position is obtained from the target position generation unit 501 if target position correction according to the embodiment is not performed and exhibits a profile as shown in FIG. 10.

In step S601, which may serve as a second comparison means, it is checked whether or not the PWM signal (PWM) output from the PWM generation unit 504 has reached the upper limit value (PWM_MAX). The upper limit value of PWM is 100%. If PWM<PWM_MAX, the process ends. If PWM=PWM_MAX, the process advances to step S602. If PWM<PWM_MAX, the process of this embodiment is not executed because even the delay of the target position detection time can easily be recovered without any large variation in speed by controlling to increase the PWM value (the duty value).

In step S602, it is checked whether or not the control phase is in the constant speed region. If the servo control phase is in the constant speed region, the process advances to step S603. If the servo control phase is not in the constant speed region, the process ends. The process of this embodiment is unnecessary outside the constant speed region because the load on the conveyance mechanism varies in the constant speed region.

In step S603, it is checked whether or not a difference (D) between the detected position and the (ideal) target position is larger than a predetermined amount (ΔP). ΔP is a distance in which the target position increases in every servo period (ΔT). FIG. 7 shows the relationship between the difference (D) and the predetermined amount (ΔP). In FIG. 7, at, e.g., time T=T1+ΔT, D≦ΔP.

If D>ΔP, the process advances to step S604. If D≦ΔP, the process of the embodiment ends. This is because if the difference between the detected position and the target position is equal to or smaller than ΔP, the difference can easily be recovered by servo control without any large variation in speed.

In step S604, ΔT is added to the delay (Tdelay) from the ideal detection time of the target position. In FIG. 7, at, e.g., time T=T1+2ΔT, D>ΔP holds. At this time, ΔP should be added to the value of a position (P) to obtain the ideal target position. Instead, the time of addition is delayed by ΔT. According to FIG. 7, the delay (Tdelay) at time T=T1=+2ΔT is Tdelay=ΔT. The delay (Tdelay) is reset to "0" before the start of servo control. During servo control, only the addition process is executed without resetting the value.

On the basis of Tdelay output from the target position delay unit 505 in this way, the target position generation unit 501 outputs a target position at a timing delayed by Tdelay.

According to the above-described process, if the load on the conveyance mechanism is heavy, and it is determined that it is difficult to recover the delay of target position detection time by servo control without any large variation in speed, the target position detection time is delayed in terms of time.

This delay allows adjustment to difference (D)<ΔP at, e.g., T=T1+3ΔT in FIG. 7.

According to the process in FIG. 6, the correction is made in terms of time. Instead, the correction may be made in terms of distance itself.

In a case where only the conveyance roller is driven, the process shown in FIG. 6 is not executed. More specifically, in the arrangement shown in FIG. 5, the target position generation unit 501 does not execute the process of receiving a delay from the target position delay unit 505 and generating the delay (Tdelay) or deviation (Pdelay). Instead, servo control is performed on the basis of the target position output from the target position generation unit 501 and the detected position and detected speed obtained from the encoder 3. This is because when the conveyance roller conveys a printing medium, no heavy load on the conveyance mechanism as shown in FIG. 10 occurs.

Figure 8:
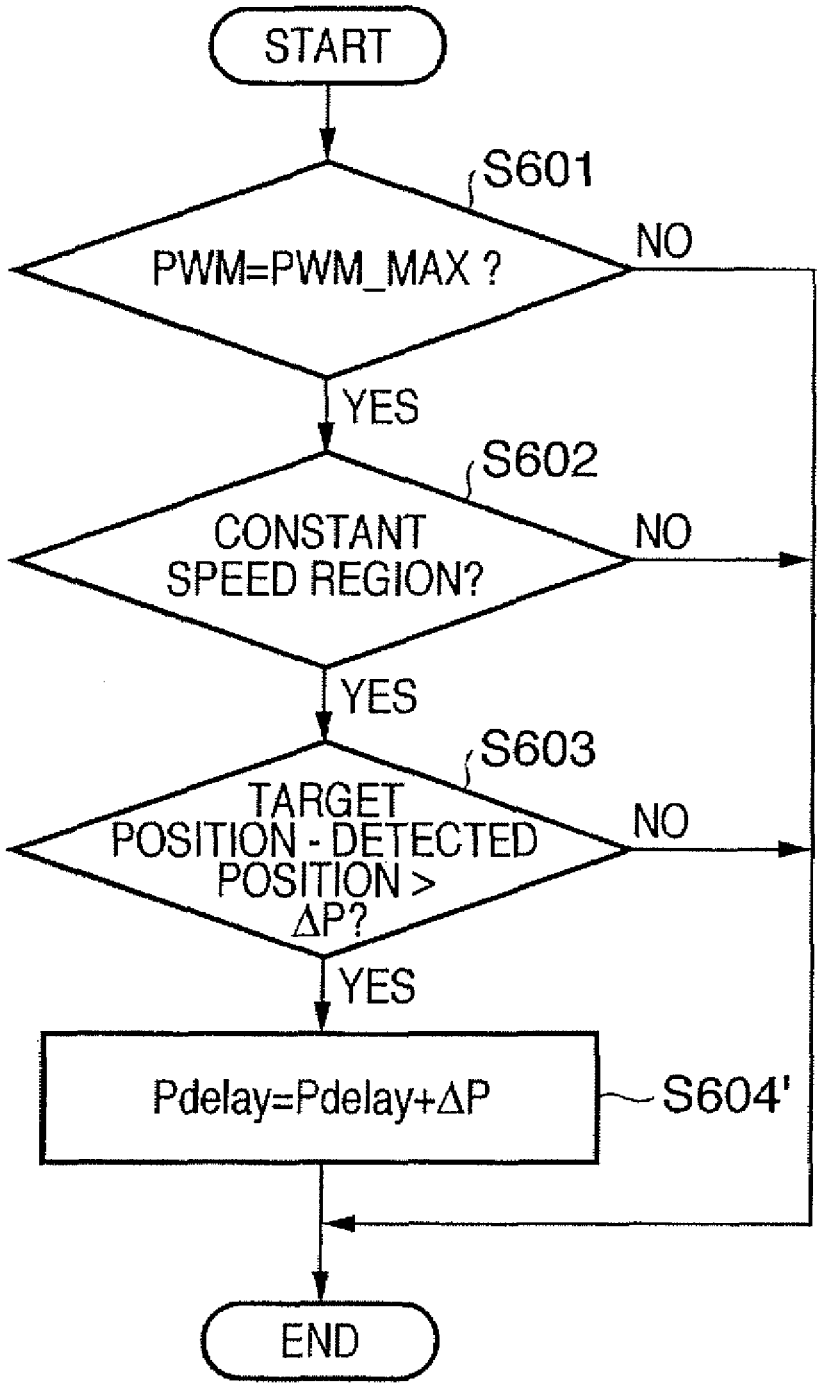
FIG. 8 is a flowchart illustrating another process of the target position delay unit.

FIG. 8 is a flowchart illustrating another process of the target position delay unit, which is repeatedly executed in every servo period (ΔT). In steps S601 to S603 in FIG. 8, the same process as in FIG. 6 is executed. In step S6041, ΔP is added to the deviation (Pdelay) from the ideal target position. Pdelay is reset to "0" before the start of servo control. During servo control, only the addition process is executed without resetting the value.

Pdelay is defined as the difference between the ideal target position and the corrected target position, as shown in FIG. 7. In FIG. 7, at, e.g., time T=T1+2ΔT, ΔP should be added to the value of the position (P) to obtain the ideal target position. However, since D>ΔP, ΔP is not added. Hence, the corrected target position has a deviation corresponding to ΔP from the ideal target position.

As described above, the difference between the corrected target position and the detected position is checked in every servo control period (ΔT). The deviation (Pdelay) is added such that the difference (D) satisfies D<ΔP, and increases. At, e.g., time T=T1+5ΔT in FIG. 7, Pdelay=3ΔP. This adjustment allows to make D<ΔP hold again at time T=T1+6ΔT.

According to the above-described embodiment, for example, even though the load on the conveyance mechanism is heavy, and the PWM signal output of servo control reaches the upper limit value (PWM_MAX) at time T=T1, as shown in FIG. 7, it is still possible to correct the target position in terms of position or time. This makes the difference between the target position and the detected position fall within ΔP even when the load is eliminated at time T=T2.

For this reason, it is unnecessary to increase the rotational speed of the motor and convey a printing medium at a high speed to eliminate the difference. The detected position by the encoder never becomes excessively larger with respect to the target position.

Figure 9:
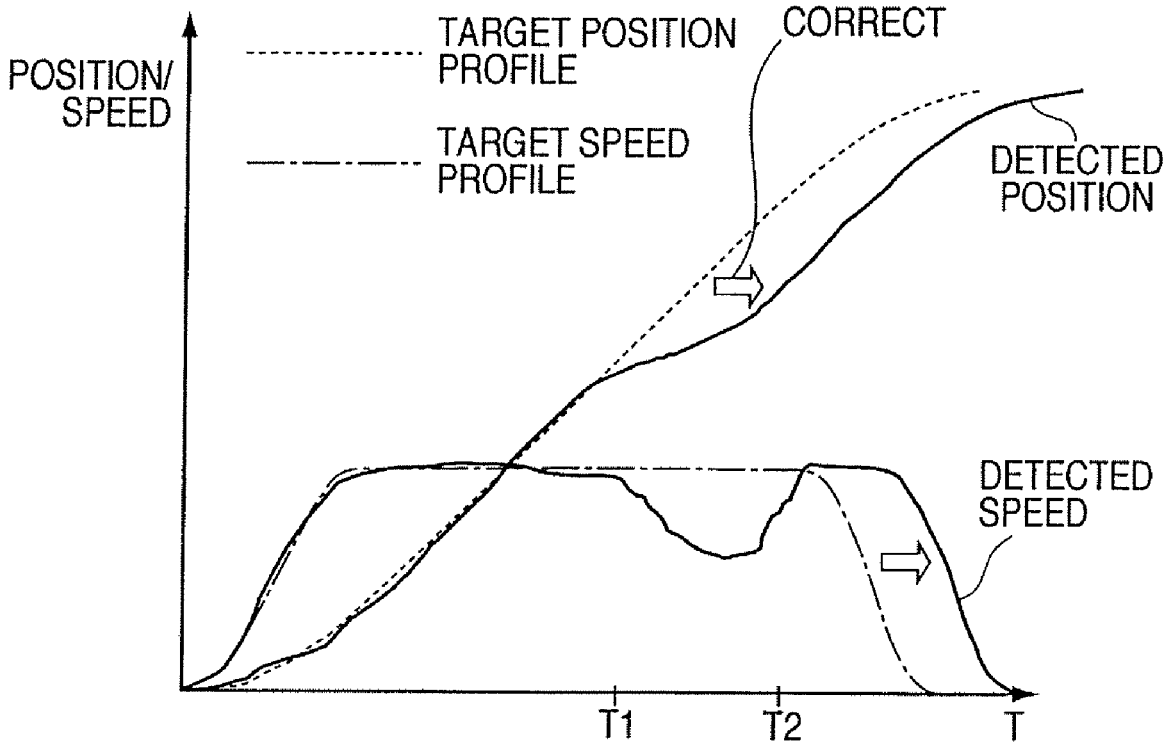
FIG. 9 is a graph showing comparison between a corrected target position profile and a detected position profile and comparison between a target speed profile and a corrected detected speed profile obtained in accordance with the embodiment of the present invention.

FIG. 9 is a graph showing comparison between a detected position, detected speed, corrected target position, and corrected target speed obtained by the embodiment.

As shown in FIG. 9, according to the embodiment, a printing medium can accurately be conveyed to the final target position even after the load on the conveyance mechanism varies.

As described above, according to this embodiment, although a slightly longer time is required until the end of feed upon feeding a printing medium, it is possible to accurately convey the printing medium regardless of the variation of the load on the conveyance mechanism at that time. This allows to accurately move the printing medium to the print start position.

The arrangement for transmitting the driving force of the motor 1 to the feed roller is not limited to that of the above-described embodiment. The following arrangement is also applicable. When the carriage moves to a predetermined position to bring down the feed lever 8, transmission means becomes operable (operation enabled). The driving force of the motor 1 is transmitted to the feed roller 4 via the transmission means. When the carriage moves from the predetermined position to another position, the feed lever 8 rises, the transmission means becomes inoperable (operation disabled). In this case, the driving force of the motor 1 is not transmitted to the feed roller 4.

When the motor 1 rotates in the reverse direction in the operable (operation enabled) state of the transmission means, the feed roller rotates in the forward direction through the transmission means to feed a printing medium from the feed tray so that the tip of the printing medium can be conveyed to the conveyance roller that is rotating in the reverse direction.

Figure 12:
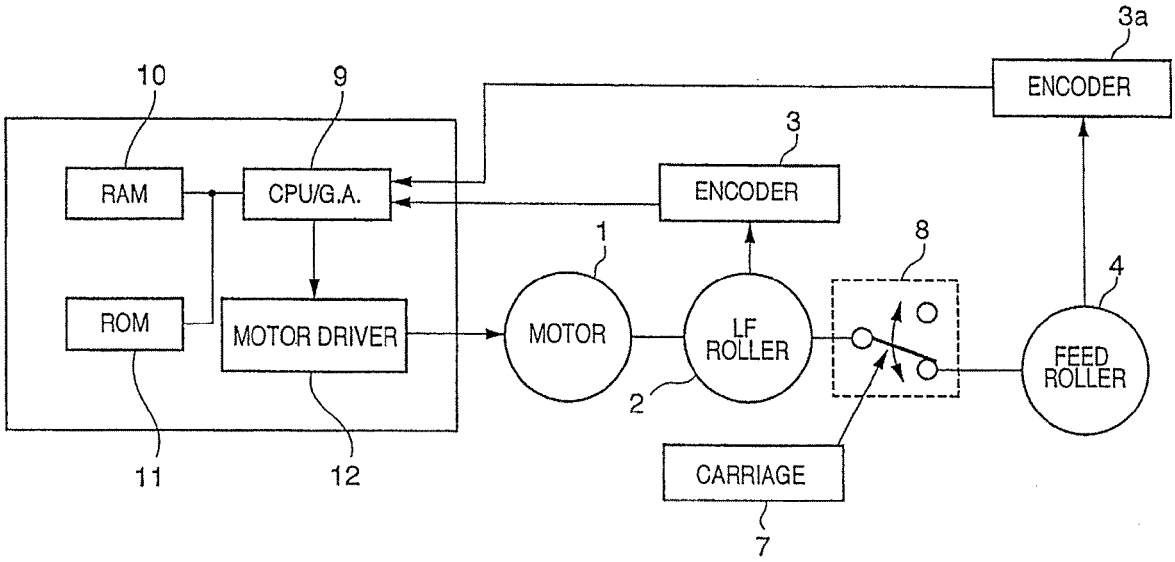
FIG. 12 is a block diagram showing another control arrangement of the printing apparatus.

In the above-described embodiment, the encoder is provided on the LF roller 2. An encoder 3*a* for the feed roller may be provided in addition to the encoder 3 for the LF roller, as shown in FIG. 12. In this case, the CPU/G.A. 9 may have a function (not shown) of selecting the signal from one of the encoders. With this arrangement, the CPU/G.A. 9 can control driving of the LF roller 2 by using the position information and speed information of the encoder 3 and control driving of the feed roller 4 by using the position information and speed information of the encoder 3*a*.

In the above-described embodiment, droplets discharged from the printhead are ink droplets, and the liquid stored in the ink tank is ink. However, the liquid stored is not limited to ink. For example, a kind of processed liquid which is discharged to a printing medium to increase the fixing effect and water repellency of a printed image or increase the image quality may be stored in the ink tank.

In the above-described embodiment, particularly, of inkjet printing methods, a method using a means (e.g., an electrothermal transducer or laser beam) for generating heat energy as energy utilized to discharge ink is employed so that the ink state is changed by the heat energy. This results in attaining high printing density and resolution.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-186978, filed Jul. 6, 2006, which is hereby incorporated by reference herein in its entirety.

What is claimed is:

1. A printing apparatus for printing on a printing medium by a printhead, comprising:

a first roller which conveys the printing medium from a stacking position of the printing medium into the printing apparatus;

a DC motor which supplies a driving force to said first roller;

an encoder which detects a rotation amount of said first roller;

generation means for generating a target position to cause said first roller to feed the printing medium;

correction means for correcting the target position generated by said generation means;

control means for generating a PWM signal on the basis of (1) the target position generated by said generation means or corrected by said correction means and (2) a detected position derived from the rotation amount detected by said encoder, and servo-controlling said DC motor by the PWM signal;

first comparison means for repeatedly comparing the target position generated by said generation means or corrected by said correction means with the detected position derived from the rotation amount detected by said encoder in every servo period; and correction control means for controlling said correction means to perform correction in a case where a difference between the target position and the detected position, obtained by comparison result by said first comparison means, is larger than a predetermined threshold value.

2. The apparatus according to claim 1, further comprising second comparison means for comparing the PWM signal with a predetermined maximum output value of the PWM signal, wherein said correction control means controls said correction means to perform correction in a case where the PWM signal reaches the maximum output value.

3. The apparatus according to claim 2, wherein said correction control means controls said correction means to perform correction in a case where rotation of said DC motor is in a constant speed region.

4. The apparatus according to claim 3, wherein the constant speed region corresponds to a feed operation period of the printing medium driven by said first roller in terms of time.

5. The apparatus according to claim 1, wherein correction by said correction means is one of correction of the target position itself and correction of a target time when the printing medium reaches the target position.

6. The apparatus according to claim 1, wherein said correction means corrects the target position at a servo period of servo control by said control means.

7. The apparatus according to claim 1, further comprising:

a second roller which conveys the printing medium fed by said first roller to a print position of the printhead; and another encoder which detects a rotation amount of said second roller.

8. A feeding apparatus which conveys a stacked printing medium to a predetermined position, comprising:

a first roller which conveys the printing medium from a stacking position of the printing medium into a printing apparatus which uses the printing medium;

a DC motor which supplies a driving force to said first roller;

an encoder which detects a rotation amount of said first roller;

generation means for generating a target position to cause said first roller to feed the printing medium;

correction means for correcting the target position generated by said generation means;

control means for generating a PWM signal on the basis of (1) the target position generated by said generation means or corrected by said correction means and (2) a detected position derived from the rotation amount detected by said encoder, and servo-controlling said DC motor by the PWM signal;

comparison means for repeatedly comparing the target position generated by said generation means or corrected by said correction means with the detected position derived from the rotation amount detected by said encoder in every servo period; and correction control means for controlling said correction means to perform correction in a case where a difference between the target position and the detected position, obtained by comparison result by said first comparison means, is larger than a predetermined threshold value.

9. A method of feeding a stacked printing medium via a roller to which a driving force is supplied from a servo-controlled DC motor, comprising the steps of:

detecting a rotation amount of the roller by using an encoder;

generating a target position to feed the printing medium by the roller;

correcting the target position generated in the generating step;

generating a PWM signal on the basis of (1) the target position generated in the generating step or corrected in the correcting step and (2) a detected position derived from the rotation amount detected by the encoder, and servo-controlling the DC motor by the PWM signal;

repeatedly comparing the target position generated in the generating step or corrected in the correcting step with the detected position derived from the rotation amount detected by the encoder in every servo period; and controlling to perform correction in the correcting step in a case where a difference between the target position and the detected position, obtained by comparison result in said comparing step, is larger than a predetermined threshold value.

* * * * *